United States Patent [19]

Derman et al.

[11] 4,000,933

[45] Jan. 4, 1977

[54] SHAFT SEALING AND BEARING ARRANGEMENT, ESPECIALLY FOR PROPELLER SHAFTS

[76] Inventors: Karl Gustaf Derman, Sorgardsvagen 7, S-433 00 Partille; Nils-Erik Bohman, Granvagen 1, S-330 12 Forsheda, both of Sweden

[22] Filed: July 8, 1975

[21] Appl. No.: 593,964

[52] U.S. Cl. ..... 308/237 R; 308/DIG. 12; 115/34 R

[51] Int. Cl.[2] ..... B63H 5/06

[58] Field of Search ..... 308/237 R, 237 A, 240, 308/DIG. 12, 36.3; 115/34 R

[56] References Cited

UNITED STATES PATENTS

| | | | |
|---|---|---|---|
| 2,306,664 | 12/1942 | Paine | 115/34 R X |
| 3,177,841 | 4/1965 | Galoska | 115/34 R |
| 3,428,017 | 2/1969 | Altson | 115/34 R |

*Primary Examiner*—Philip Goodman
*Assistant Examiner*—Gene A. Church
*Attorney, Agent, or Firm*—Albert L. Jeffers; Roger M. Rickert

[57] ABSTRACT

A sealing and bearing arrangement for propeller shafts for boats wherein a sleeve of an elastic material encloses the shaft and forms a bearing portion accessible to the water and also forming a sealing portion on the opposite side of the bearing portion in relation to the water, the sealing portion being adapted to be guided in a radial direction by the bearing portion.

5 Claims, 3 Drawing Figures

SHAFT SEALING AND BEARING ARRANGEMENT, ESPECIALLY FOR PROPELLER SHAFTS

BACKGROUND OF THE INVENTION

1. Field of the Invention

The present invention relates to a sealing and bearing arrangement for shafts, especially propeller shafts.

2. Description of the Prior Art

In a device previously known for sealing and journalling a propeller shaft extending from an inboard motor there is used a conventional water lubricated bearing and a packing box which has to be tightened now and then. Thus, the devices previously known comprise a great number of elements which is a substantial drawback and also have the drawback of transferring the vibrations of the motor to the hull of the boat. Also for other purposes there is a demand for a simple and reliable sealing and bearing device having the property of taking up and dampening vibrations.

SUMMARY OF THE INVENTION

The object of the invention is to provide a simple and reliable arrangement for bearing and journalling a shaft, especially a propeller shaft for boats.

In order to comply with this object the arrangement comprises a sleeve of an elastic material, said sleeve enclosing the shaft and forming a bearing portion accessible to the liquid and also forming a sealing portion of the opposite side of the bearing portion in relation to the liquid, the sealing portion being adapted to be guided in radial direction by the bearing portion.

Thus, the devices previously known for sealing and journalling shaft have been substituted by one single element which has the advantage of providing a substantial dampening of the vibrations of the shaft.

In a preferred embodiment of the arrangement the sleeve is only at one end thereof connected with the boat by sealingly enclosing a tube extending through the bottom of the boat. Preferably the bearing portion of the sleeve is constituted by a number of longitudinal projections distributed around the inner periphery of the sleeve and separated from each other by means of projections. Preferably the sealing portion is formed by one or several sealing lips directed obliquely inwards and in the direction of the bearing portion.

BRIEF DESCRIPTION OF THE DRAWING

The invention is described in more detail in the following with reference to the accompanying drawing.

DESCRIPTION OF THE PREFERRED EMBODIMENT

Figure 1:
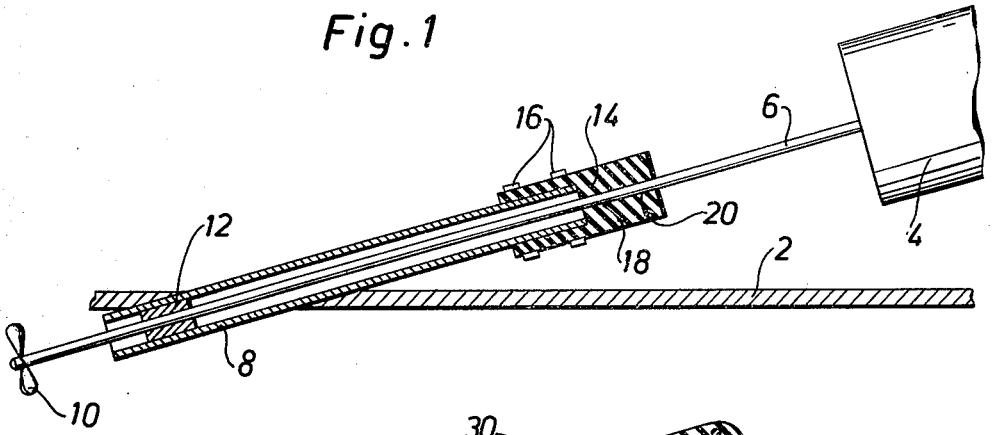
FIG. 1 schematically shows an arrangement in accordance with the invention.

In FIG. 1 reference numeral 2 designates the bottom of a boat and reference numeral 4 designates an inboard motor mounted in the boat. From the motor 4 there extends a shaft 6 extending out into the water through a tube 8 fixed to the bottom 2 of the boat. At its outer end the shaft 6 is provided with a propeller 10. At its outer end the tube 8 is provided with a water lubricated bearing 12 for the shaft 6, said bearing allowing the water to circulate up through the tube. At its upper end the tube 8 supports a sleeve 14, which by means of straps 16 or the like is tightened against the tube 8. The sleeve 14 consists of rubber or another high elastic material and comprises a bearing portion 18 and a sealing portion 20. The sleeve 14 is shown more in detail and at an enlarged scale in FIGS. 2 and 3.

Figure 2:
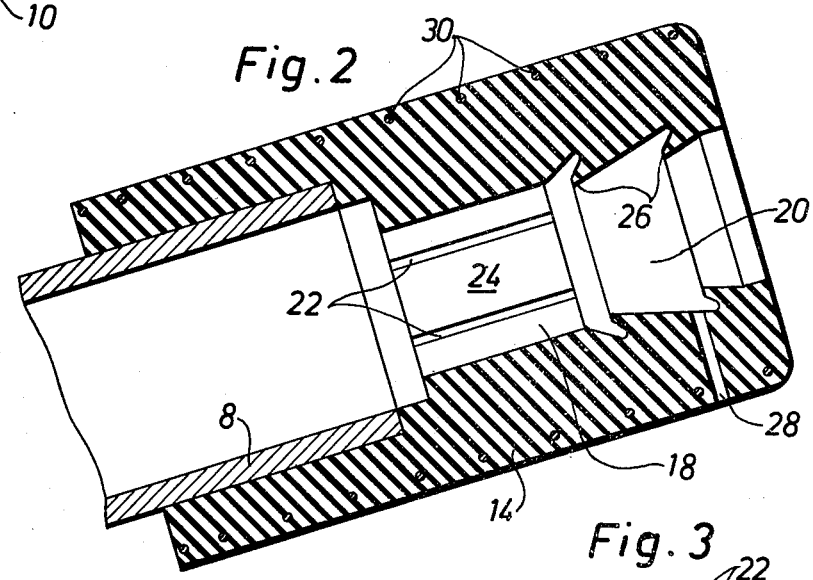
FIG. 2 is a section on an enlarged scale of a portion of the arrangement of FIG. 1
Figure 3:
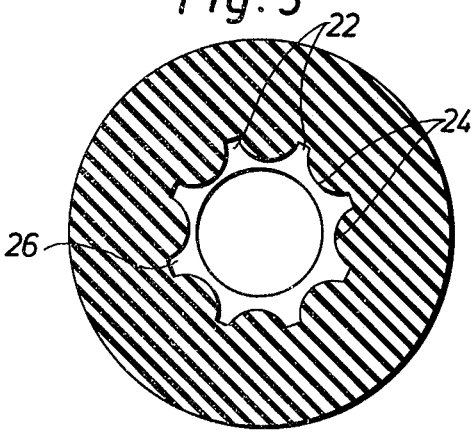
FIG. 3 is a section along line II—II in FIG. 2.

In FIGS. 2 and 3 the sleeve 14 is shown without the shaft 6. As mentioned above the tube 8 extends into the sleeve 14, the sleeve being sealingly tightened around the tube 8. The bearing portion 18 of the sleeve for journalling the shaft is constituted by a number of longitudinal projections 24 distributed around the inner periphery of the sleeve. The projections 24 are convex shape and are separated from each other by means of notches 22. In accordance with FIGS. 2 and 3 the sleeve can be provided with eight projections. The bearing portion 18 is water lubricated by the fact that the water is allowed to circulate up through the tube 8 and into the bearing portion 18 through the notches 22. At the side of the bearing portion 18 adjacent to the motor the sleeve 14 is provided with the sealing portion 20. The sealing portion 20 consists of two circumferential sealing lips 26 extending obliquely inwards and in the direction of the bearing portion 18. Because of this position the lips 26 will be pressed against the shaft 6 extending through the sleeve, the force increasing when the water pressure increases.

Through the wall of the sleeve there extends a hole 28 opening at the inner surface of the sleeve between the sealing lips 26. The hole 28 can be used for forcing a lubricant into the sleeve in order to reduce the friction of the sealing lips 26 against the shaft 6.

The sleeve can be reinforced by means of a spring insert 30.

The sleeve 14 constitutes a simple unit which provides the sealing as well as the journalling of the shaft 6. Because of the fact that the sleeve is supported only at one end the sleeve will dampen and absorb the vibrations of the shaft 6 so that the motor vibrations will not be transferred to the hull of the boat. The sleeve always follows the radial movements of the shaft so that the sealing action of the sleeve is maintained.

The invention can be modified within the scope of the following claims, especially with regard to the construction of the bearing portion as well as the sealing portion of the sleeve 14.

We claim:

1. A sealing and bearing arrangement for an axially extending propeller shaft for a boat where one end of the arrangement is to be immersed in water comprising a sleeve of elastic material elongated in the direction of shaft extension and sealingly engaging the boat in a region near one end only of the sleeve, the sleeve enclosing the shaft and including a shaft bearing portion axially spaced from the region of the sleeve engaging the boat and accessible to the water, the sleeve further including a sealing portion at the side of the bearing portion axially opposite from the liquid and from the sleeve one end which engages the boat, the sealing portion being adapted to be guided in the radial direction by the bearing portion.

2. An arrangement as claimed in claim 1, characterized in that the bearing portion comprises a number of longitudinal projections distributed around the inner periphery of the sleeve and separated from each other by means of notches.

3. An arrangement as claimed in claim 1, characterized in that the sealing portion comprises one or several sealing lips obliquely directed inwards and in the direction of the bearing portion.

4. An arrangement as claimed in claim 1, characterized in that the sleeve is adapted to follow the movements of the shaft in the radial direction.

5. A device as claimed in claim 1, characterized in that the sleeve sealingly encloses at its end adjacent the bearing portion a tube extending through the bottom of the boat to be supported by the boat.

* * * * *